United States Patent [19]

Davidsson et al.

[11] 4,074,849

[45] Feb. 21, 1978

[54] BLANK FOR FORMING A RECEPTACLE HAVING OPPOSITE HANDLES

[75] Inventors: Sven Davidsson; Nils Bertil Christensson; Per Hugo Axelsson, all of Lund, Sweden

[73] Assignee: AB Akerlund & Rausing, Lund, Sweden

[21] Appl. No.: 767,818

[22] Filed: Feb. 11, 1977

[30] Foreign Application Priority Data

Apr. 21, 1976 Sweden ..... 7604564

[51] Int. Cl.[2] ..... B65D 3/06; B65D 5/46

[52] U.S. Cl. ..... 229/1.5 B; 229/4.5; 229/52 B

[58] Field of Search ..... 229/1.5 B, 4.5, 52 B

[56] References Cited

U.S. PATENT DOCUMENTS

| | | | |
|---|---|---|---|
| 1,384,725 | 7/1921 | Levy | 229/4.5 UX |
| 2,574,927 | 11/1951 | Mastin | 229/52 B |
| 2,925,208 | 2/1960 | Wood | 229/1.5 B |
| 3,391,847 | 7/1968 | Christine et al. | 229/1.5 B X |
| 3,533,332 | 10/1970 | Young et al. | 229/1.5 B |
| 3,988,521 | 10/1976 | Fumel et al. | 229/1.5 B X |

*Primary Examiner*—Davis T. Moorhead

*Attorney, Agent, or Firm*—Lerner, David, Littenberg & Samuel

[57] ABSTRACT

A blank for forming a receptacle is provided which includes a substantially circular bottom member, a pair of side members each connected to portions of said bottom member, and each of said side members including at one end thereof handle ears integrally formed with the side members. The blank is erected to form a receptacle wherein the bottom member forms the bottom wall of the receptacle, and the side members cooperate to form the sidewall of the receptacle. The handle ears are formed on opposite ends of the side members, such that when the blank is formed into a receptacle, the handle ears are positioned diametrically opposite each other on the sidewall of the receptacle.

9 Claims, 3 Drawing Figures

BLANK FOR FORMING A RECEPTACLE HAVING OPPOSITE HANDLES

FIELD OF THE INVENTION

The present invention relates generally to receptacles, and specifically to an improved blank for forming a receptacle having integrally-formed handle means. The receptacle is shaped to be used as a distribution package and/or as a disposable cup for consumption of bouillon, soup, or the like.

BACKGROUND OF THE INVENTION

Receptacles made of cardboard or similar material having an internal deep-drawn protective layer of plastic material are conventional and are well known in the prior art. In addition, by employing suitable materials, such as polypropene for the protective layer, such receptacles may be employed to contain hot fluids. Typically, such receptacles are of the disposable type.

It is also conventional with respect to such disposable receptacles to provide handle means by pasting handle ears onto the sidewall of the receptacle. Typically, such handle ears are applied to the receptacles after they have been formed into their final shape. In addition, in order to allow the receptacle or cup to be firmly grasped, the handle ears are usually provided at spaced locations on the sidewall.

In some cases, the receptacle is filled with the hot fluid before the handle ears are pasted on or applied to the receptacle. However, it would be desirable to provide handling means for the receptacle before it is filled with the hot fluids so that the receptacle may be handled during the filling process.

However, in order to apply the handling means to the receptacles prior to their being filled, the handling means must be of such a type which would not interfere with the normal manufacturing methods for manufacturing the blanks and the receptacles formed therefrom.

Broadly, it is an object of the present invention to provide an improved blank for forming a receptacle which solves the foregoing problems. Specifically, it is within the contemplation of the present invention to provide an improved blank for forming a receptacle wherein the blank includes the handling means which cooperate in the formed receptacle to form the handle ears, which handle ears can therefore be utilized during the process of filling the receptacle with hot fluids.

SUMMARY OF THE INVENTION

Briefly, in accordance with the principles of this invention, an improved blank for forming a receptacle is provided which includes a substantially circular bottom member, a pair of side members each connected to portions of said bottom member, with each side member including at one end thereof handle ears integrally formed with the side members. When the blank is formed into a receptacle, the bottom member forms the bottom wall of the receptacle and the pair of side members form the sidewall of the receptacle. In addition, when the blank is erected to form the receptacle, the handle ears, which are formed on opposite ends of the side members, cooperate such that the handle ears are positioned at diametrically opposite points of the sidewall of the erected receptacle.

In the preferred form, the receptacle includes an internal protective layer of plastic material, and the blank is formed of cardboard or similar material. In addition, in the preferred form, each of the side members includes an extension member joined thereto by weakened or perforated lines, with the handle ears being punched out of the extension members. Finally, in the preferred form, the handle ears extend substantially along the entire height of the formed receptacle, and the bottom ends of the handle ears are provided with external edges which extend obliquely upward in order to facilitate the lifting of the receptacle.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF THE PREFERRED EMBODIMENT OF THE INVENTION

Figure 1:
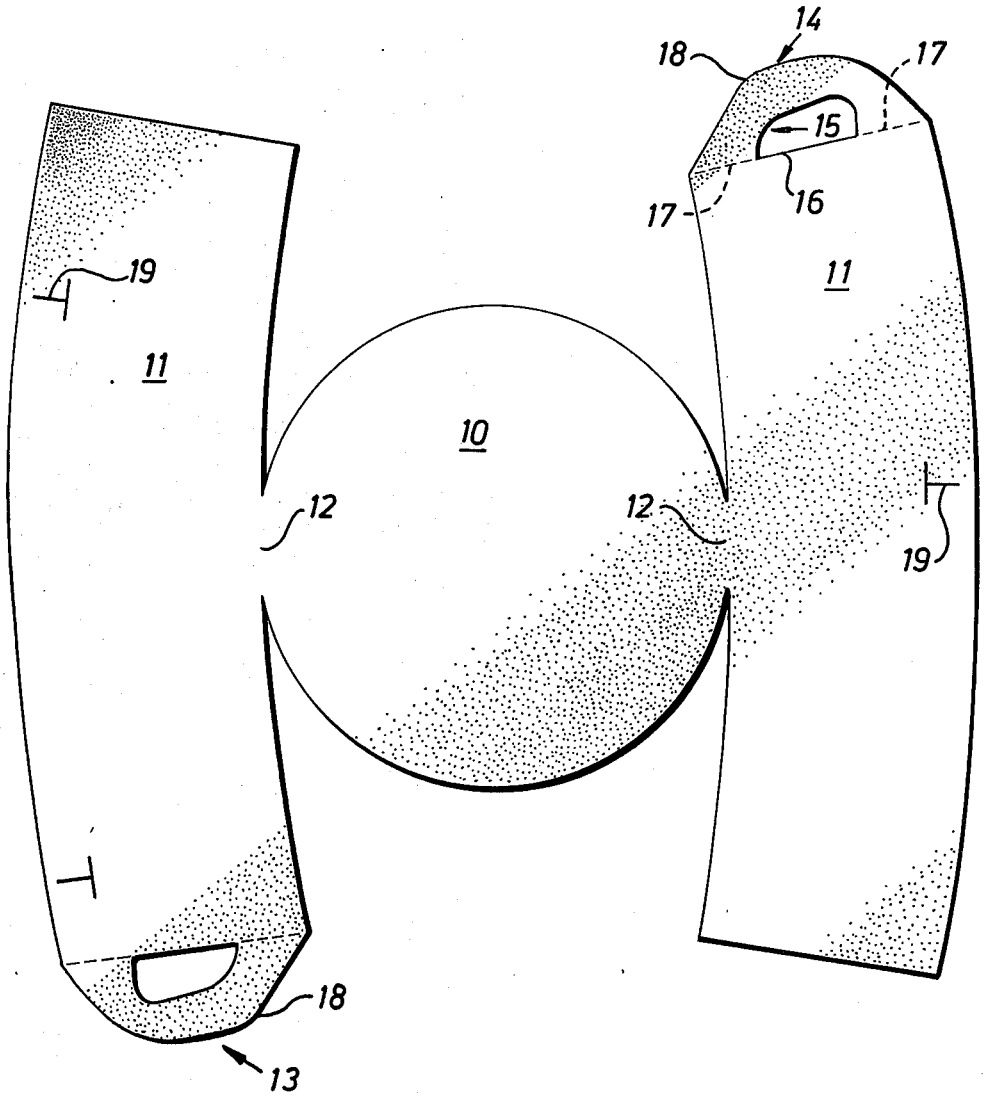
FIG. 1 shows a plan view of the improved receptacle blank in its unfolded form.

Referring now to FIG. 1, there is illustrated the unfolded blank for forming the receptacle, formed from cardboard or similar material. The blank includes a substantially circular bottom member 10 which forms the bottom wall of the receptacle. Side members 11 are provided which form the sidewall of the receptacle, and such side members 11 are integrally connected to bottom member 10 by means of two connecting portions 12 which are positioned diametrically opposite each other.

Each side member 11 is provided with a handle ear 13 formed or punched out of an extension portion of each side member 11. Each handle ear 13 is provided with an external limiting edge 14, and internal limiting edge 15, and a rectilinear portion 16. The limiting edge 15 and rectilinear portion 16 define an opening in the handle ear. Weakening lines 17 are provided between the side member 11 and the extension portion, which weakening lines 17 extend substantially along the total width of the handle ear 13 and the side member 11.

Figure 2:
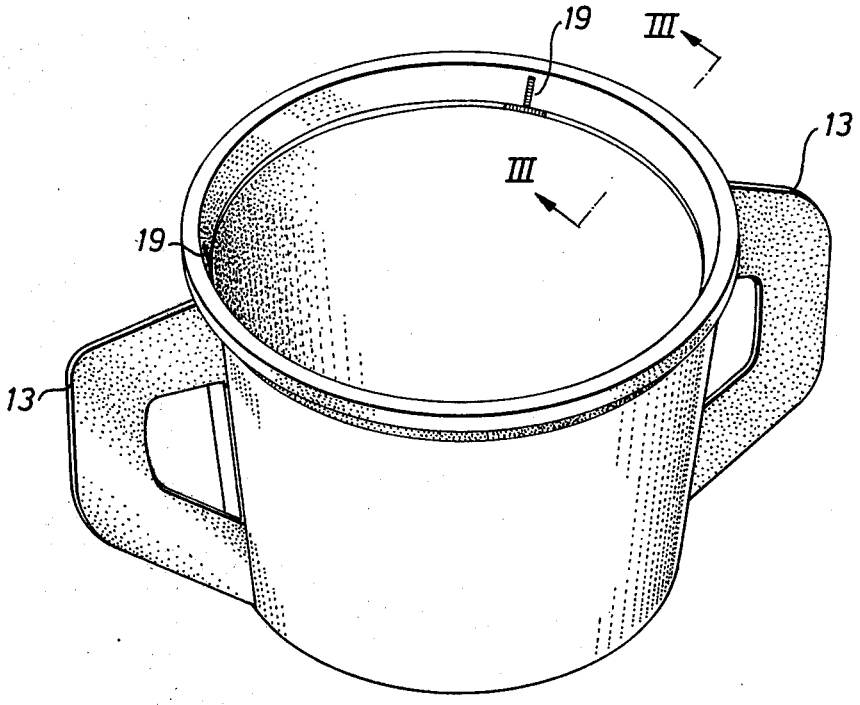
FIG. 2 is a perspective view illustrating the receptacle formed from the blank of FIG. 1.

As shown in FIG. 2, once the blank is erected to form the receptacle, the handle ears 13 will be oriented so as to extend radially outwardly from the sidewall of the receptacle, and the handle ears 13 will be positioned diametrically opposite each other.

Figure 3:
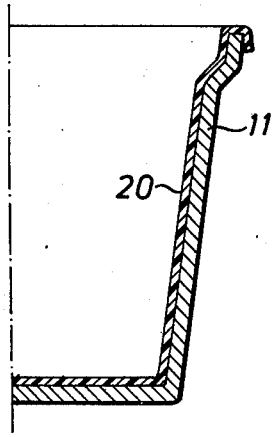
FIG. 3 is a sectional view, taken along line 2—2 of FIG. 2, showing a partial section through the sidewall of the receptacle.

Referring to FIG. 3, in the preferred form, the receptacle is provided with an internal protective layer 20 which may be suitably attached to the sidewall of the receptacle, in a conventional manner.

The method of erecting the receptacle, and the method for applying the protective layer to the receptacle, are conventional and need not be described in detail. However, it should be noted that as a result of the orientation of the handle ears 13, and as a result of beveled portions 18 of the handle ears 13, the handle ears do not disturb the pulling of the receptacle blank into a deep-drawing mold for applying the protective layer 20.

In a conventional manner, the receptacle may be provided with denesting means. Such denesting means may include an arrangement whereby the inner protective layer of plastic material 20 is pulled outwardly through T-shaped slots 19 formed in the sidewall of the receptacle. The receptacle may also be provided with a retracted bottom so that the sliding of the receptacle is made more difficult.

A latitude of modification, change, and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A blank for forming a receptacle comprising:

a substantially circular bottom member, a pair of side members each connected to portions of said bottom member, such that when said blank is formed into a receptacle, said bottom member forms the bottom wall of said receptacle, and said side members cooperate to form the sidewall of said receptacle, and each of said side members including on only one end thereof one extension member, said extension members being formed on opposite ends of said respective side members such that they cooperate to form diametrically opposed handle means on the sidewall of said formed receptacle.

2. The blank of claim 1 further including an internal protective layer of plastic material.

3. The blank of claim 1 wherein said blank is formed of cardboard or similar material.

4. The blank of claim 1 wherein each of said extension members are joined to said side members by weakening means.

5. The blank of claim 4 wherein said handle means are formed by punching portions out of said extension members.

6. The blank of claim 1 wherein each of said side members is connected to said bottom member by connecting means positioned diametrically opposite each other.

7. The blank of claim 1 wherein said handle means are in the form of handle ears.

8. The blank of claim 7 wherein each of said handle ears extends along the entire height of said sidewall in its erected form.

9. The blank of claim 8 wherein each of said handle ears includes, at the end closest to said bottom member, an external edge extending at an angle in order to facilitate the lifting of the formed receptacle.

* * * * *